US009593656B2

(12) United States Patent
Fujita

(10) Patent No.: US 9,593,656 B2
(45) Date of Patent: Mar. 14, 2017

(54) FUEL INJECTOR AND CALIBRATION TUBE THEREOF

(71) Applicant: DELPHI TECHNOLOGIES, INC., Troy, MI (US)

(72) Inventor: Mahoro M. Fujita, Fairport, NY (US)

(73) Assignee: Delphi Technologies Inc., Troy, MI (US)

( * ) Notice: Subject to any disclaimer, the term of this patent is extended or adjusted under 35 U.S.C. 154(b) by 211 days.

(21) Appl. No.: 14/104,120

(22) Filed: Dec. 12, 2013

(65) Prior Publication Data

US 2015/0167610 A1 Jun. 18, 2015

(51) Int. Cl.

| | |
|---|---|
| ***F02M 61/16*** | (2006.01) |
| ***F02M 51/06*** | (2006.01) |
| ***F02M 61/06*** | (2006.01) |
| ***F02M 65/00*** | (2006.01) |

(52) U.S. Cl.

CPC ..... *F02M 65/001* (2013.01); *F02M 51/0678* (2013.01); *F02M 61/168* (2013.01); *F02M 2200/505* (2013.01); *F02M 2200/8061* (2013.01); *F02M 2200/8092* (2013.01); *Y10T 29/49314* (2015.01)

(58) Field of Classification Search

CPC ..... F02M 61/165; F02M 61/168; F02M 51/0685; F02M 2051/08; F02M 51/0671; F02M 2200/80; F02M 2200/8092; F02M 2200/8061; F02M 2200/505; A01G 25/023

USPC ... 239/585.1, 533.2, 533.9, 584, 575, 585.3, 239/533.3, 533.4, 533.6, 533.7, 533.11, 239/533.12, 585.2, 585.5, 585.4, DIG. 23

See application file for complete search history.

(56) References Cited

U.S. PATENT DOCUMENTS

| | | | | |
|---|---|---|---|---|
| 5,335,863 | A * | 8/1994 | DeGrace | 239/575 |
| 6,019,128 | A * | 2/2000 | Reiter | 137/549 |
| 6,328,232 | B1 * | 12/2001 | Haltiner, Jr. | F02M 51/0614 239/533.2 |
| 6,421,913 | B1 * | 7/2002 | Bonnah, II | F02M 51/0667 228/173.4 |
| 6,601,785 | B2 * | 8/2003 | Bulgatz | F02M 51/0671 239/533.2 |
| 6,644,568 | B1 * | 11/2003 | Porter | F02M 51/0671 239/533.9 |
| 6,654,995 | B1 | 12/2003 | Wang et al. | |
| 6,997,404 | B2 * | 2/2006 | Rao | 239/585.1 |
| 7,252,249 | B2 * | 8/2007 | Molnar | 239/585.4 |

(Continued)

*Primary Examiner* — Darren W Gorman
*Assistant Examiner* — Christopher R Dandridge
(74) *Attorney, Agent, or Firm* — Joshua M. Haines

(57) ABSTRACT

A fuel injector includes a valve member for selectively preventing and permitting flow of fuel through a valve seat by selectively engaging and disengaging the valve seat, an actuator for selectively applying a force to the valve member in order to unseat the valve member from the valve seat, and a return spring which biases the valve member into contact with the valve seat when the actuator is not applying the force to the valve member. A calibration tube is positioned within the fuel tube and holds the return spring in compression so as to set a force on the return spring to achieve a desired dynamic flow of fuel through the fuel injector. The calibration tube includes at least one protrusion extending outward therefrom such that the protrusion engages the fuel tube, thereby creating a spring fit between the calibration tube and the fuel tube.

11 Claims, 5 Drawing Sheets

(56) References Cited

U.S. PATENT DOCUMENTS

2002/0179747 A1* 12/2002 Bulgatz ..... F02M 51/0671
239/585.1

* cited by examiner

FUEL INJECTOR AND CALIBRATION TUBE THEREOF

TECHNICAL FIELD OF INVENTION

The present invention relates a fuel injector for supplying fuel to a fuel consuming device; more particularly to such a fuel injector which includes a spring for biasing a valve member into contact with a valve seat, and still even more particularly to such a fuel injector which includes a calibration tube for setting the spring force of the spring.

BACKGROUND OF INVENTION

Fuel injectors are well known for supplying a precisely metered amount of fuel to a fuel consuming device, for example, an internal combustion engine, where the fuel may be liquid or gaseous. The fuel injector generally includes a fuel inlet, a fuel outlet, and a valve member which is reciprocated to seat and unseat with a valve seat. Seating the valve member with the valve seat prevents fuel from flowing from the fuel inlet to the fuel outlet while unseating the valve member with the valve seat permits fuel to flow from the fuel inlet to the fuel outlet. A return spring is used to urge the valve member into contact with the valve seat while an actuator, commonly a solenoid, is used to apply a force to the valve member in order to unseat the valve member from the valve seat. In operation, when the actuator does not apply a force to the valve member, the return spring keeps the valve member seated with the valve seat, thereby preventing fuel from flowing from the fuel inlet to the fuel outlet. Conversely, when the actuator applies a force to the valve member, the valve member compresses the return spring and the valve member is unseated from the valve seat, thereby allowing fuel to flow from the fuel inlet to the fuel outlet. When the actuator ceases applying a force to the valve member, the return spring again urges the valve member to be seated with the valve seat.

The valve member is seated and unseated with the valve seat with high frequency, for example from four times per second to one hundred or even more times per second. Consequently, the time it takes the valve member to unseat (move the valve member from the seat to full open) and the time it takes the return spring to seat the valve member with the valve seat is important in determining the amount of fuel that is allowed to flow from the fuel inlet to the fuel outlet because if the valve member is unseated too quickly and seated too slowly due to low spring force, then too much fuel will be allowed to flow while if the valve member is unseated too slowly and seated too quickly due to high spring force, then not enough fuel will be allowed to flow. The force of the return spring determines the speed at which the valve member is opened and seated with the valve seat. Therefore, when the fuel injector is assembled, the force of the spring is deliberately set to achieve a desired dynamic flow through the fuel injector. As used herein, dynamic flow is the rate of flow of the fuel through the fuel injector over a period of time where the valve member is seated and unseated a plurality of times over the period of time. The spring force is set by adjusting the amount of compression that is applied to the return spring by a calibration tube. While the dynamic flow through the fuel injector is being monitored, the calibration tube is moved to change the amount of compression applied to the return spring until the desired dynamic flow rate is obtained.

It is known in the art of fuel injectors that the calibration tube mates with a fuel tube in a press fit relationship to fix the position of calibration tube in the fuel tube. It is also known in the art of fuel injectors that the fuel tube may include inwardly extending protrusions which mate with the calibration tube as will be described in greater detail below with reference to FIGS. 1 and 2. The protrusion create a spring fit between the calibration tube and the fuel tube, thereby However, as will also be described in greater detail below with reference to FIGS. 1 and 2, there may not be sufficient room on the fuel tube to provide inward protrusions of sufficient length to accommodate the range of axial positions of the calibration tube that may be needed to achieve the desired compression of the return spring.

What is needed is a fuel injector which minimizes or eliminates one or more of the shortcomings set forth above.

SUMMARY OF THE INVENTION

Briefly described, a fuel injector is provided for supplying fuel to a fuel consuming device. The fuel injector includes a fuel inlet for receiving the fuel, a fuel outlet for dispensing the fuel from the fuel injector, and a fuel tube defining a fuel passage at least in part from the fuel inlet to the fuel outlet. The fuel injector also includes a valve member for selectively preventing and permitting flow of the fuel through a valve seat by selectively engaging and disengaging the valve seat, an actuator for selectively applying a force to the valve member in order to unseat the valve member from the valve seat, and a return spring which biases the valve member into contact with the valve seat when the actuator is not applying the force to the valve member. A calibration tube is positioned within the fuel tube such that the return spring is held in compression between the valve member and the calibration tube so as to set a force on the return spring to achieve a desired dynamic flow of fuel through the fuel injector. The calibration tube includes at least one protrusion extending outward therefrom such that the protrusion engages the fuel tube, thereby creating a spring fit between the calibration tube and the fuel tube. The protrusion does not limit the range of adjustment of the calibration tube within the fuel tube and allows the fuel injector to be made more axially compact.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
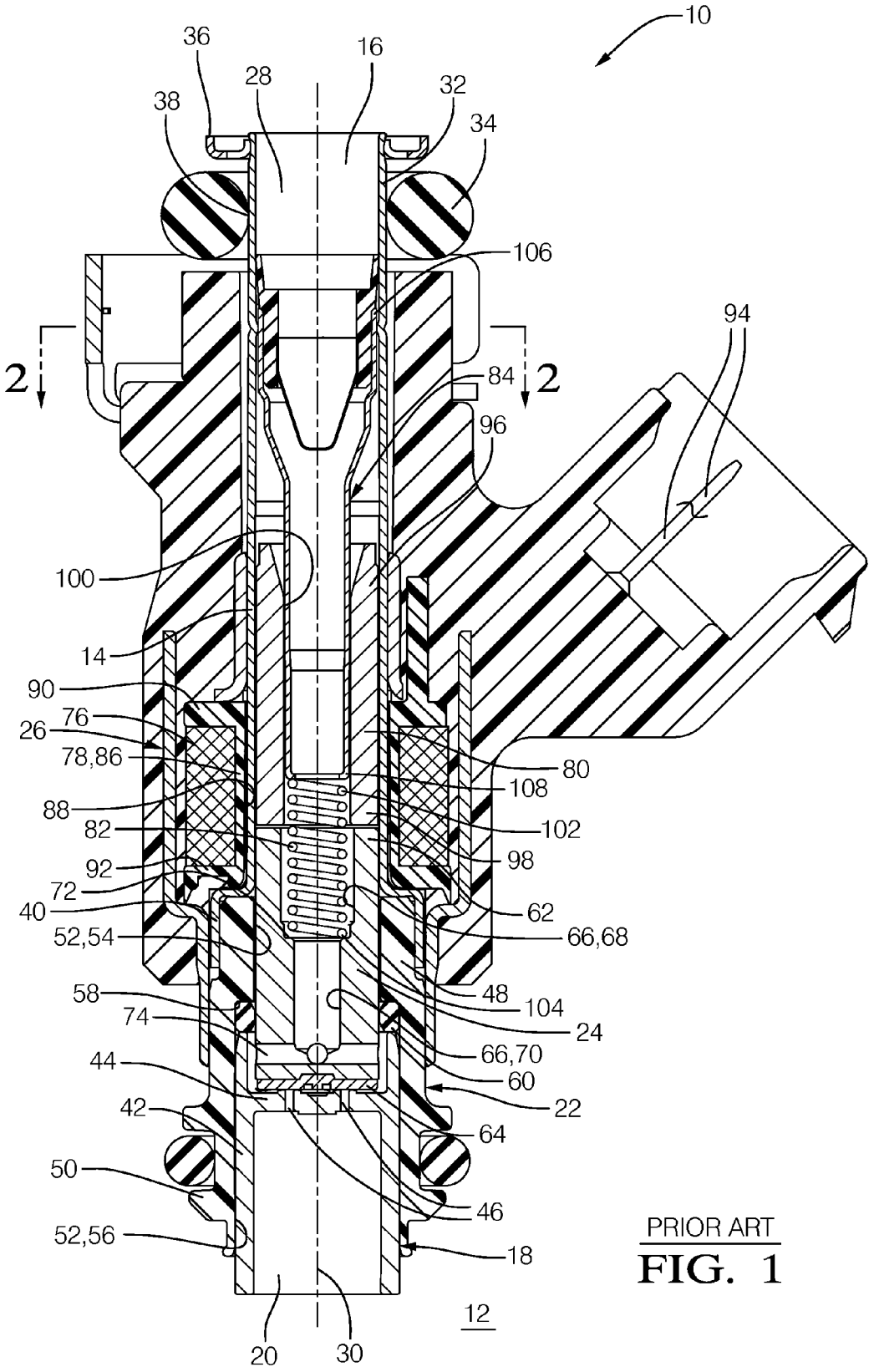
PRIOR ART FIG. 1
FIG. 1 is an axial cross-sectional view of a prior art fuel injector.
Figure 2:
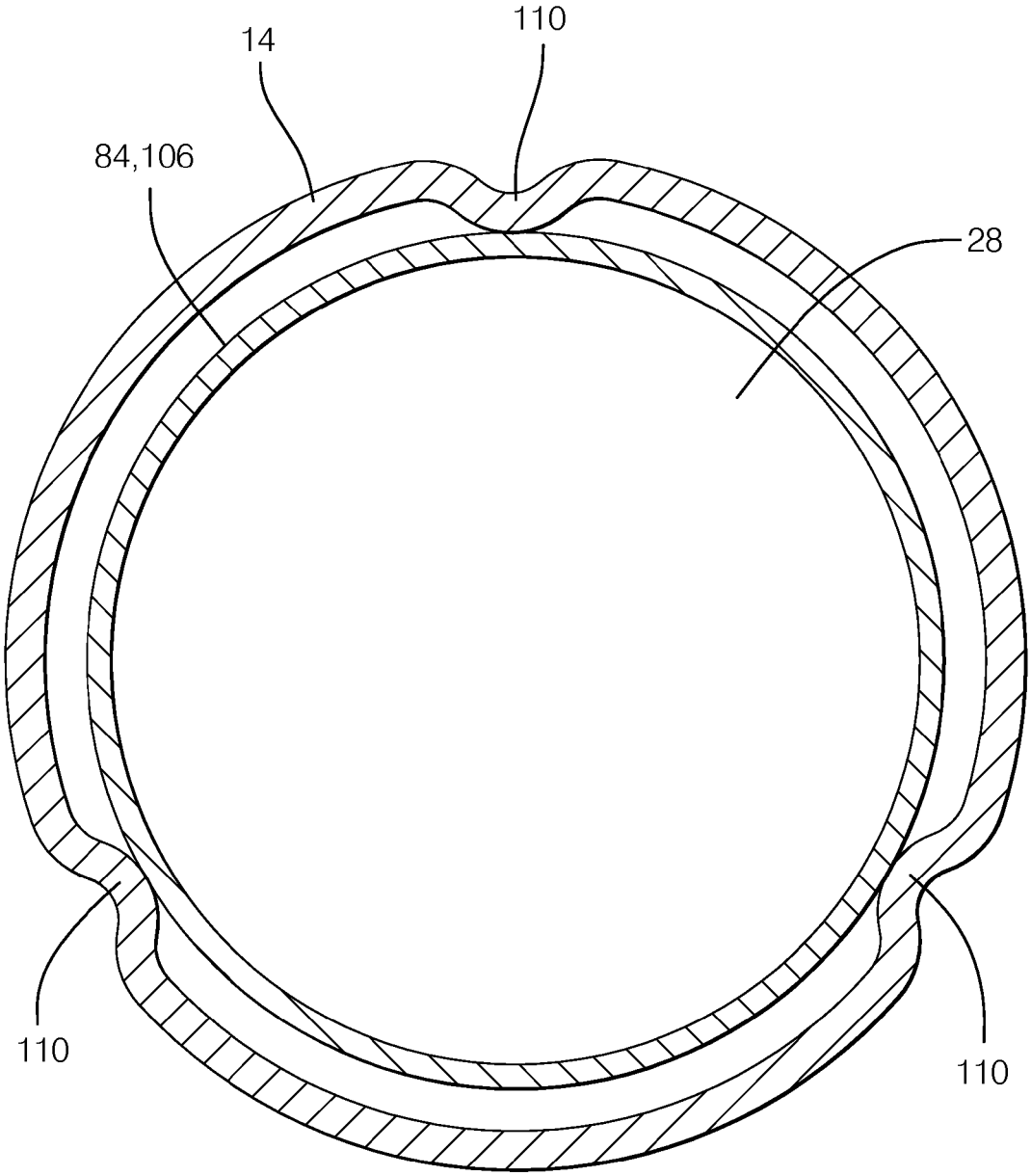
PRIOR ART FIG. 2
FIG. 2 is a radial cross-sectional view of the fuel injector of FIG. 1 taken through section line 2-2.

Reference will be made to FIGS. 1 and 2 which show a prior art fuel injector 10 for supplying fuel to a fuel consuming device illustrated as an internal combustion engine 12. Fuel injector 10 generally includes a fuel tube 14 defining a fuel inlet 16 for receiving fuel, a valve seat assembly 18 defining a fuel outlet 20 for dispensing fuel from fuel injector 10, a fuel injector body 22 attached to fuel tube 14 and valve seat assembly 18, a valve member 24 for selectively allowing and preventing fuel to pass from fuel inlet 16 to fuel outlet 20, and an actuator 26 for selectively seating and unseating valve member 24 with valve seat assembly 18.

Fuel tube 14 is hollow and substantially cylindrical and defines at least in part a fuel passage 28 from fuel inlet 16 to fuel outlet 20. Fuel tube 14 extends along a fuel injector axis 30 and includes a fuel tube upper end 32 which is arranged to be received within a fuel injector socket (not shown) of a fuel rail (not shown) from which fuel injector 10 receives fuel. Fuel tube upper end 32 receives an o-ring 34 which provides a fuel-tight seal between fuel tube 14 and the fuel injector socket of the fuel rail, thereby preventing fuel from escaping to the environment. Fuel tube upper end 32 defines a retention flange 36 which retains o-ring 34 on fuel tube 14. Fuel tube upper end 32 also defines an o-ring sealing surface 38 on an outside surface thereof which has a surface profile and finish which can make a fuel-tight seal with o-ring 34. Fuel tube 14 also includes a fuel tube lower end 40 which is enlarged in diameter for receiving a portion of fuel injector body 22 therein as will be described in greater detail later.

Valve seat assembly 18 is defined by a tubular body 42 extending along fuel injector axis 30 in a coaxial relationship with fuel tube 14 and defines fuel outlet 20 at one end thereof. Valve seat assembly 18 includes a vale seat 44 which traverses the inside of body 42. Valve seat 44 includes a plurality of flow apertures 46 extending therethrough. Valve member 24 is selectively mated or seated with valve seat 44 to prevent fuel from flowing from fuel inlet 16 to fuel outlet 20 through flow apertures 46. Conversely, valve member 24 is selectively unmated or unseated with valve seat 44 to permit fuel to flow from fuel inlet 16 to fuel outlet 20 through flow apertures 46.

Fuel injector body 22 is substantially cylindrical and extends along fuel injector axis 30 in a coaxial relationship with fuel tube 14 and valve seat assembly 18 from a fuel injector body upper end 48 that is proximal to fuel tube 14 to a fuel injector body lower end 50 that is distal from fuel tube 14. Fuel injector body upper end 48 is received within fuel tube lower end 40 of fuel tube 14 and fixed thereto, for example, by welding. Fuel injector body 22 includes a fuel injector stepped bore 52 extending coaxially therethrough such that fuel injector stepped bore 52 includes a smaller diameter portion 54 that is proximal to fuel tube 14 and a larger diameter portion 56 that is proximal to valve seat assembly 18 such that a fuel injector body shoulder 58 is formed where smaller diameter portion 54 meets larger diameter portion 56. Valve seat assembly 18 is disposed within larger diameter portion 56 of fuel injector stepped bore 52 and fixed thereto, for example, by welding. A valve guide 60 which is ring shaped may be captured tightly axially between fuel injector body shoulder 58 and valve seat assembly 18 in order to guide valve member 24 in use. Valve guide 60 allows valve member 24 to move axially substantially uninhibited while substantially preventing radial movement of valve member 24.

Valve member 24 is made of a magnetic material, is substantially cylindrical, and extends along fuel injector axis 30 in a coaxial relationship with fuel tube 14, valve seat assembly 18, and fuel injector body 22 from a valve member upper end 62 that is proximal to fuel tube 14 to a valve member lower end 64 that is proximal to valve seat assembly 18. Valve member 24 includes a valve member stepped bore 66 extending axially thereinto from valve member upper end 62. Valve member stepped bore 66 includes a larger diameter portion 68 proximal to valve member upper end 62 and a smaller diameter portion 70 extending from larger diameter portion 68 toward valve seat assembly 18 such that a spring seat 72 is formed where smaller diameter portion 70 meets larger diameter portion 68. A cross bore 74 extends through valve member 24 in a direction substantially perpendicular to fuel injector axis 30 such that cross bore 74 intersects with smaller diameter portion 70 of valve member stepped bore 66. In this way, valve member stepped bore 66 and cross bore 74 define a flow path for fuel through valve member 24 for supplying fuel to valve seat 44.

Valve member upper end 62 is received within fuel tube 14 in a close sliding relationship such that valve member 24 is able to move axially within fuel tube 14 substantially uninhibited while radial movement of valve member 24 within fuel tube 14 is substantially prevented. Valve member 24 acts as an armature for actuator 26 as will be described in more detail later.

Actuator 26 is a solenoid which includes a coil 76 wound around a spool 78, a pole piece 80, a return spring 82, and a calibration tube 84. Fuel tube 14 extends through spool bore 88. Spool 78 is made of a material which does not conduct electricity, for example, plastic. Spool 78 includes spool cylinder 86 which is coaxial with fuel tube 14 and includes a spool bore 88 which extends axially through spool cylinder 86 in a coaxial relationship with spool cylinder 86. Spool 78 also includes spool rims 90, 92 which extend radially outward from the ends of spool cylinder 86. Spool rim 90 extends radially outward from the end of spool cylinder 86 which is proximal to fuel inlet 16 while spool rim 92 extends radially outward from the end of spool cylinder 86 which is proximal to fuel outlet 20. Electrically conductive wire is wound around spool cylinder 86 between spool rims 90, 92 to form coil 76 which is connected to terminals 94 which are connected to an electric current source (not shown). Spool 78 and coil 76 together define a solenoid coil assembly.

Pole piece 80 is made of a magnetic material, is substantially cylindrical, and extends along fuel injector axis 30 in a coaxial relationship with fuel tube 14 from a pole piece upper end 96 that is proximal to fuel inlet 16 to a pole piece lower end 98 that is proximal to valve member 24. Pole piece 80 includes a pole piece bore 100 which extends axially through pole piece 80 in a coaxial relationship therewith. Pole piece 80 is positioned within fuel tube 14 and fixed thereto, for example, by press fit and/or welding. Pole piece lower end 98 of pole piece 80 acts as a stop to limit the distance valve member 24 is able to move away from valve seat 44. It should be noted that pole piece 80 is a part of the magnetic circuit of actuator 26 which functions to control the magnetic flux distribution.

Return spring 82 is a coil compression spring which extends from a return spring upper end 102 positioned within pole piece bore 100 to a return spring lower end 104 which mates with spring seat 72 of valve member 24. Return spring upper end 102 mates with calibration tube 84 as will be discussed in greater detail later and is held in compression between calibration tube 84 and valve member 24 to bias valve member 24 toward valve seat 44.

Calibration tube 84 extends along fuel injector axis 30 in a coaxial relationship with fuel tube 14 from a calibration tube upper end 106 to a calibration tube lower end 108. Calibration tube lower end 108 is sized to fit within pole piece bore 100 of pole piece 80 while calibration tube upper end 106 is sized to form an interference fit with inwardly extending protrusions 110 of fuel tube 14. In this way, return spring 82 is grounded to fuel tube 14 through calibration tube 84. Protrusions 110 are formed by deforming fuel tube 14 from the outside periphery thereof; consequently, each protrusion 110 defines a recess on the outside surface of fuel tube 14. Calibration tube 84 is hollow, thereby allowing fuel to flow therethrough from fuel inlet 16 to valve member stepped bore 66.

In operation, when no electric current is supplied to coil 76, return spring 82 urges valve member 24 into contact with valve seat 44, thereby preventing fuel from flowing from fuel inlet 16 to fuel outlet 20. When electric current is supplied to coil 76, a magnetic field is generated which creates an attractive force between valve member 24 and pole piece 80, thereby causing valve member 24 to move toward pole piece 80 and compressing return spring 82. In this way, valve member 24 is unseated from valve seat 44 and fuel is permitted to flow from fuel inlet 16 to fuel outlet 20. When the supply of electric current to coil 76 is stopped, return spring 82 again moves valve member 24 into contact with valve seat 44 since the attractive force between valve member 24 and pole piece 80 no longer exists.

Fuel injector 10 must supply a precisely metered amount of fuel to internal combustion engine 12 from the time valve member 24 is unseated from valve seat 44 until the time valve member 24 is again seated with valve seat 44. The amount of fuel metered by fuel injector 10 is determined at least in part by the force of return spring 82 because the force of return spring 82 determines the amount of time it takes to for valve member 24 to be seated with valve seat 44 when the supply of electric current to coil 76 is stopped. If the force of return spring 82 is too great, not enough fuel will be passed from fuel inlet 16 to fuel outlet 20 because return spring 82 will move valve member 24 into contact with valve seat 44 too rapidly. Conversely, if the force of return spring 82 is too small, too much fuel will be passed from fuel inlet 16 to fuel outlet 20 because return spring 82 will move valve member 24 into contact with valve seat 44 too slowly. Consequently, it is important to set the force of return spring 82 to a level that will produce desired dynamic flow of fuel from fuel inlet 16 to fuel outlet 20. In order to do this, the extent to which calibration tube 84 compresses return spring 82 is adjusted by changing the axial position of calibration tube 84. Dynamic flow through fuel injector 10 may be measured and calibration tube 84 can be moved axially until the desired flow rate is obtained. In order to accommodate the range of axial positions that calibration tube 84 may fall within fuel tube 14, protrusions 110 are elongated in the same direction as fuel injector axis 30, thereby ensuring that calibration tube 84 makes sufficient contact with protrusions 110 for the range of axial positions that calibration tube 84 may fall within. Protrusions 110 create a spring fit between calibration tube 84 and fuel tube 14 and reduce the manufacturing tolerances of calibration tube 84 and fuel tube 14 compared to an arrangement where a cylindrical portion of calibration tube 84 would form a press fit with a cylindrical portion of fuel tube 14. It should be noted that protrusions 110 have been exaggerated in size in FIG. 2 for clarity.

Figure 3:
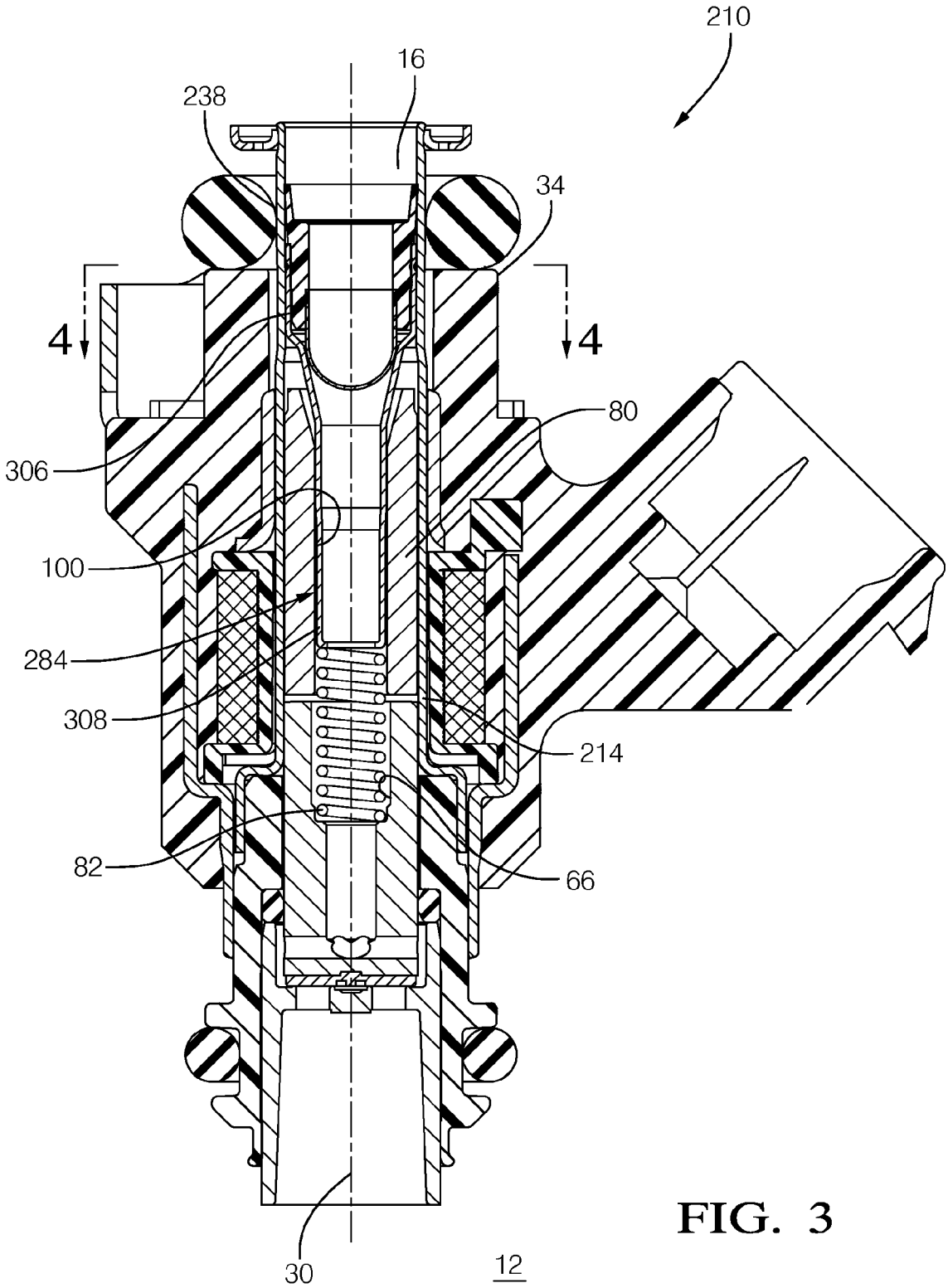
FIG. 3 is an axial cross-sectional view of a fuel injector in accordance with the present invention.
Figure 4:
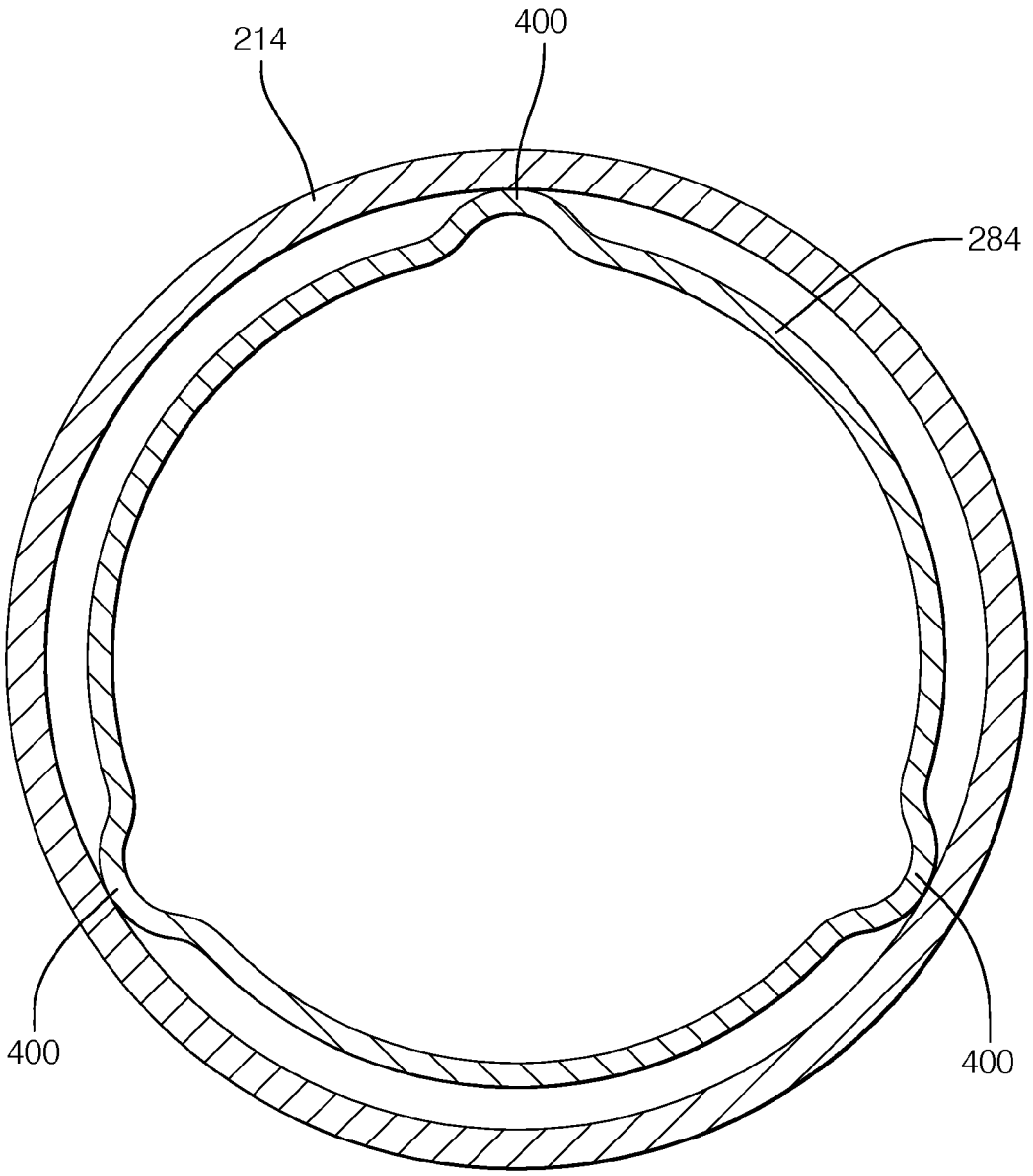
FIG. 4 is a radial cross-sectional view of the fuel injector of FIG. 3 taken through section line 4-4.
Figure 5:
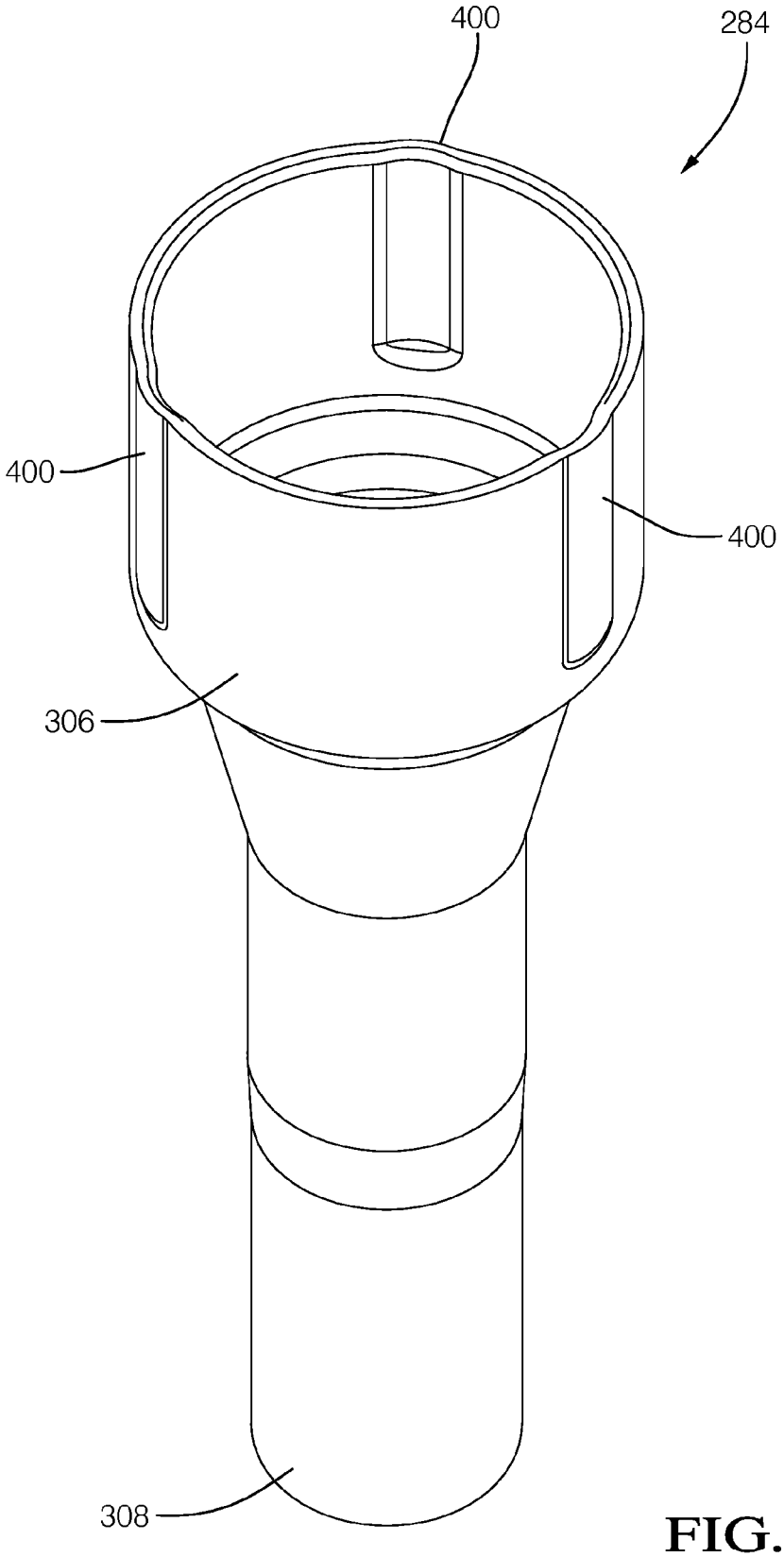
FIG. 5 is an isometric view of a calibration tube of the fuel injector in accordance with the present invention.

In accordance with a preferred embodiment of this invention and referring to FIGS. 3, 4, and 5, a fuel injector 210 is shown for supplying fuel to internal combustion engine 12. Fuel injector 210 is substantially the same as fuel injector 10 except that modifications have been made to decrease the axial length of fuel injector 210 compared to fuel injector 10. Elements of fuel injector 210 that are substantially the same as fuel injector 10 will described using the same reference numbers as used to describe fuel injector 10, elements of fuel injector 210 that are different than elements of fuel injector 10 will be described using 200 added to the reference number of the element of fuel injector 10, and elements of fuel injector 210 that are new will be described using 400 series reference numbers. In order to decrease the length of fuel injector 210 compared to fuel injector 10, fuel injector 210 is provided with a fuel tube 214 which is shorter in length compared to fuel tube 14 of fuel injector 10. The reduced length of fuel tube 214 does not allow sufficient space for protrusions 110 which are provided in fuel tube 14 because protrusions 110 would need to extend into o-ring sealing surface 238 of fuel tube 214 in order to be sufficiently long to accommodate the range of axial positions that calibration tube 284 may fall within fuel tube 214. Protrusions 110 on o-ring sealing surface 238 would be unacceptable because o-ring 34 would not be able to form a fuel-tight seal with the recesses that are formed by protrusions 110. Consequently, fuel tube 214 does not have protrusions 110 and fuel injector 210 is provided with calibration tube 284 as will be described in the paragraphs that follow.

Calibration tube 284 extends along fuel injector axis 30 in a coaxial relationship with fuel tube 214 from a calibration tube upper end 306 to a calibration tube lower end 308. Calibration tube lower end 308 is sized to fit within pole piece bore 100 of pole piece 80 while calibration tube upper end 306 is arranged to form an interference fit with fuel tube 214. In order to make an interference fit with fuel tube 214, calibration tube upper end 306 includes protrusions 400 which extend radially outward therefrom. Protrusions 400 are elongated in the same direction as fuel injector axis 30. While three protrusions 400 are shown, it should now be understood that a greater or less number of protrusions 400 may be included. In this way, return spring 82 is grounded to fuel tube 114 through calibration tube 184. Calibration tube 284 is hollow, thereby allowing fuel to flow therethrough from fuel inlet 16 to valve member stepped bore 66.

The extent to which calibration tube 284 compresses return spring 82 is adjusted by changing the axial position of calibration tube 284. Dynamic flow through fuel injector 210 may be measured and calibration tube 284 can be moved axially until the desired dynamic flow rate is obtained. Unlike calibration tube 84 which has an adjustment range that is limited by the extent that protrusions 110 are elongated axially, the range of adjustment of calibration tube 284 is not limited because protrusions 400 are located on calibration tube 284. Furthermore, protrusions 400 may be radially surrounded by o-ring sealing surface 238 of fuel tube 214. Protrusions 400 create a spring fit between calibration tube 284 and fuel tube 214. It should be noted that protrusions 110 have been exaggerated in size in FIG. 4 for clarity.

While fuel injector 210 has been illustrated as one of skill in the art would recognize as a fuel injector for injecting gaseous fuel, it should now be understood that the invention is equally applicable to fuel injectors for injecting liquid fuels. More specifically, the valve member and valve seat may take the form of a ball or frustoconical valve member and tapered seat respectively as are commonly utilized by liquid or gaseous fuel injectors.

While this invention has been described in terms of the preferred embodiments thereof, it is not intended to be so limited, but rather only to the extent set forth in the claims that follow.

I claim:

1. A fuel injector for supplying fuel to a fuel consuming device, said fuel injector comprising:

a fuel inlet for receiving said fuel;

a fuel outlet for dispensing said fuel from said fuel injector;

a fuel tube defining a fuel passage at least in part from said fuel inlet to said fuel outlet;

a valve member for selectively preventing and permitting flow of said fuel through a valve seat by selectively engaging and disengaging said valve seat;

an actuator for selectively applying a force to said valve member in order to unseat said valve member from said valve seat;

a return spring which biases said valve member into contact with said valve seat when said actuator is not applying said force to said valve member;

a calibration tube positioned within said fuel tube such that said return spring is held in compression between said valve member and said calibration tube, said calibration tube being positioned within said fuel tube so as to set said force on said return spring to achieve a desired dynamic flow of fuel through said fuel injector, wherein said calibration tube includes at least one protrusion extending outward therefrom such that said at least one protrusion engages said fuel tube, thereby creating a spring fit between said calibration tube and said fuel tube;

wherein said calibration tube extends along a calibration tube axis and said calibration tube includes an axial portion such that said protrusion extends radially outward from said axial portion and such that said protrusion extends circumferentially around said axial portion less than the entire perimeter of said axial portion.

2. A fuel injector as in claim 1 wherein said calibration tube includes a plurality of protrusions.

3. A fuel injector as in claim 2 wherein said plurality of protrusions are substantially equally spaced circumferentially around said calibration tube.

4. A fuel injector as in claim 2 wherein said valve member is reciprocatable along a fuel injector axis and wherein said plurality of protrusions are elongated in substantially the same direction as said fuel injector axis.

5. A fuel injector as in claim 1 wherein said fuel tube defines an o-ring sealing surface on an outside surface thereof for sealingly receiving an o-ring therein such that said o-ring sealing surface radially surrounds said at least one protrusion for at least a portion of an adjustment range of said calibration tube within said fuel tube.

6. A method for assembling a fuel injector for supplying fuel to a fuel consuming device, the fuel injector having a fuel inlet for receiving said fuel; a fuel outlet for dispensing said fuel from said fuel injector; a fuel tube defining a fuel passage at least in part from said fuel inlet to said fuel outlet; a valve member for selectively preventing and permitting flow of said fuel through a valve seat by selectively engaging and disengaging said valve seat; an actuator for selectively applying a force to said valve member in order to unseat said valve member from said valve seat; and a return spring which biases said valve member into contact with said valve seat when said actuator is not applying said force to said valve member, said method comprising:

positioning a calibration tube within said fuel tube, said calibration tube having at least one protrusion extending outward therefrom such that said at least one protrusion engages said fuel tube, thereby creating a spring fit between said calibration tube and said fuel tube, wherein said calibration tube extends along a calibration tube axis and said calibration tube includes an axial portion such that said at least one protrusion extends radially outward from said axial portion and such that said at least one protrusion extends circumferentially around said axial portion less than the entire perimeter of said axial portion; and holding said return spring in compression between said valve member and said calibration tube.

7. A fuel injector as in claim 2 wherein said plurality of protrusions are spaced circumferentially around said calibration tube.

8. A fuel injector as in claim 7 wherein said calibration tube is offset radially inward from said fuel tube between adjacent ones of said plurality of protrusions.

9. A fuel injector as in claim 7 wherein a gap is formed radially between said calibration tube and said fuel tube between adjacent ones of said plurality of protrusions.

10. A fuel injector as in claim 1 wherein said at least one protrusion engages a surface of said fuel tube that defines a cylinder.

11. A method as in claim 6 wherein said at least one protrusion engages a surface of said fuel tube that defines a cylinder.

* * * * *